US011452977B2

(12) United States Patent
Shotey et al.

(10) Patent No.: US 11,452,977 B2
(45) Date of Patent: Sep. 27, 2022

(54) WINE DECANTER PEDESTAL WITH CONTROLLABLY VARIABLE SWIRL MOTION

(71) Applicant: SwirlLab, LLC, Scottsdale, AZ (US)

(72) Inventors: Marcus J. Shotey, Scottsdale, AZ (US); Brad Carlson, Phoenix, AZ (US)

(73) Assignee: SwirlLab, LLC, Scottsdale, AZ (US)

( * ) Notice: Subject to any disclaimer, the term of this patent is extended or adjusted under 35 U.S.C. 154(b) by 370 days.

(21) Appl. No.: 16/752,580

(22) Filed: Jan. 24, 2020

(65) Prior Publication Data

US 2020/0238239 A1 Jul. 30, 2020

Related U.S. Application Data

(60) Provisional application No. 62/797,060, filed on Jan. 25, 2019.

(51) Int. Cl.

| | |
|---|---|
| ***B01F 35/22*** | (2022.01) |
| ***B01F 23/2361*** | (2022.01) |
| ***B01F 29/34*** | (2022.01) |
| ***B01F 29/80*** | (2022.01) |
| ***B01F 35/31*** | (2022.01) |

(Continued)

(52) U.S. Cl.

CPC ..... *B01F 35/2205* (2022.01); *B01F 23/2361* (2022.01); *B01F 29/34* (2022.01); *B01F 29/80* (2022.01); *B01F 35/2117* (2022.01); *B01F 35/221422* (2022.01); *B01F 35/31* (2022.01); *B01F 35/92* (2022.01); *B01F 2035/98* (2022.01); *B01F 2035/99* (2022.01); *B01F 2101/17* (2022.01)

(58) Field of Classification Search

CPC ..... B01F 13/2205; B01F 13/2117; B01F 2035/98; B01F 23/2361; B01F 29/10; B01F 29/34; B01F 29/80; B01F 35/2205; B01F 35/2117

USPC ..... 261/127

See application file for complete search history.

(56) References Cited

U.S. PATENT DOCUMENTS

| | | | | |
|---|---|---|---|---|
| 3,181,841 A * | 5/1965 | Boehm | ..... | B01F 31/25 366/217 |
| 2004/0151064 A1* | 8/2004 | Yi | ..... | B01F 31/20 366/209 |

(Continued)

FOREIGN PATENT DOCUMENTS

| | | |
|---|---|---|
| CN | 202636709 | 1/2013 |
| CN | 105747918 | 7/2016 |

*Primary Examiner* — Marc C Howell

(74) *Attorney, Agent, or Firm* — Booth Udall Fuller, PLC

(57) ABSTRACT

A wine decanter pedestal system includes a base supported above a surface, the base having a base center axis and a ledge extending outward from its top surface to support a bottom surface of a decanter placed on the top surface. A wireless receiver receives wireless commands from a wireless device to control a rotary motor operably coupled to the base at an attachment point off-center from the base center axis such that rotation of the rotary motor causes the base center axis to orbit about the rotary drive in a circular orbital motion and in a circular spin motion. A weight sensor measures a weight of a decanter placed upon the base, and a controller automatically adjusts the torque of the rotary drive in response to the weight measured by the weight sensor to increase torque for heavier weights measured and decrease torque for lighter weights measured.

20 Claims, 15 Drawing Sheets

(51) Int. Cl.

| | |
|---|---|
| ***B01F 35/92*** | (2022.01) |
| ***B01F 35/21*** | (2022.01) |
| ***B01F 35/221*** | (2022.01) |
| *B01F 35/90* | (2022.01) |
| *B01F 101/17* | (2022.01) |

(56) References Cited

U.S. PATENT DOCUMENTS

| | | | | |
|---|---|---|---|---|
| 2009/0086573 | A1* | 4/2009 | Cayley, Sr. ..... | B01F 31/22<br>366/343 |
| 2014/0308416 | A1 | 10/2014 | Cheng | |
| 2015/0329809 | A1 | 11/2015 | Cifaldi | |
| 2016/0271572 | A1 | 9/2016 | Li | |
| 2018/0304209 | A1 | 10/2018 | Hellmers et al. | |

* cited by examiner

WINE DECANTER PEDESTAL WITH CONTROLLABLY VARIABLE SWIRL MOTION

CROSS REFERENCE TO RELATED APPLICATIONS

This application claims the benefit of the filing date of U.S. Provisional Patent Application 62/797,060 entitled "WINE DECANTER PEDESTAL WITH CONTROLLABLY VARIABLE SWIRL MOTION" to Marcus J. Shotey et al., that was filed on Jan. 25, 2019, the disclosure of which is hereby incorporated herein by this reference.

TECHNICAL FIELD

Aspects of this document relate generally to wine decanting methods and apparatus, and more specifically to a wine decanting pedestal configured to support a wine decanter and cause a swirling motion of wine within the decanter through automated movement of the decanter base through a variable force applied to the base responsive to a detected weight of the wine decanter.

BACKGROUND

Wine tasters say it is customary to smell your drink prior to the first sip as part of the tasting experience. Swirling the wine in the glass prior to tasting draws oxygen from the air into the wine and enhances not only the bouquet, but also the taste of the wine. By exposing more of the wine to oxygen, it begins to break down, which is often referred to as "opening up." As the wine opens, it releases up to hundreds of different aroma compounds found in wine, and also softens, enhancing the flavor. In enhancing the smell, for example, a powerful California Cabernet may have blackberry, cedar and vanilla aroma compounds that are released all at the same time. The aroma compounds are small and carry with the evaporating alcohol to the observer's nose. A large part of wine enjoyment is the scents given off by the wine.

In a 2011 study done at the Ecole Polytechnique Federale Lausanne (entry number V057 titled "Oenodynamic": Hydrodynamic of Wine Swirling), Reclari et al. (stored in the Cornell University Library arXiv:1110.3369 [physics.flu-dyn]) defined the wave motion of wine swirling using this equation:

| | | |
|---|---|---|
| $ds = ds/D$ | $Ho = Ho/D$ | $Fr^2 = w^2 ds/g$ |

Where g is gravitational force, D is the height of the swirl wave, Ho is the depth of the wine, and w is the frequency of the rotations. For the study, Reclari et al. tested the free surface area of a swirling liquid to maximize the free surface area of the liquid. In one example, D=0.144 m, ds=0.0125 m, Ho=0.075 m and w=12 ORPM. In another example, D=0.287 m, Ds=0.05 m, Ho=0.15 m and w=8 ORPM. In still another example, D=0.287 m, ds=0.05 m, Ho=0.06 m and w=55 RPM. In still yet another example, D=0.287 m, ds=0.05 m, Ho=0.04 m and w=5 ORPM. In another test, D=0.074 m, ds=0.05 m, Ho=0.015 m and w=169 RPM. In yet another test, D=0.287 m, ds=0.0125 m, Ho=0.2 m and w=14 ORPM. In all ds=0.1736, Ho=0.52 and Fr=0.597 for the liquid tested to give optimal aeration. ds, Ho and Fr define the wave shape and ensure the similarity of the free surface.

SUMMARY

According to an aspect of the disclosure, a wine decanter pedestal system may comprise a wine decanter pedestal having a housing comprising a base configured to be supported by at least one foot above a surface upon which the wine decanter pedestal is placed, the base having a base center axis and a ledge surrounding a top surface and extending outward from the top surface, the ledge configured to support a bottom surface of a decanter placed on the top surface, a wireless receiver operatively coupled with the control input, the wireless receiver configured to receive wireless commands from a wireless device, a rotary motor positioned below the base and having a rotary drive parallel to the base center axis, the rotary motor configured to output a torque through the rotary drive, the rotary drive operably coupled to the base at an attachment point off-center from the base center axis such that rotation of the rotary motor causes the base center axis to orbit about the rotary drive in a circular orbital motion, a weight sensor operably coupled to the base and configured to measure a weight of a decanter when placed upon the base, and a controller enclosed within the wine decanter pedestal, the controller operably coupled to the wireless receiver, the rotary motor and the weight sensor, the controller configured to automatically adjust the torque of the rotary drive in response to the weight measured by the weight sensor to increase torque for heavier weights measured and decrease torque for lighter weights measured.

Particular embodiments may comprise one or more of the following features. A footprint area of the decanter may be greater than a footprint area of the wine decanter pedestal. The footprint area of the decanter may be greater than twice the footprint area of the wine decanter pedestal. The rotary drive may be rotationally coupled to the base and configured to transfer rotational motion of the rotary drive to the base such that rotation of the rotary motor causes the base to experience circular spin motion in addition to the circular orbital motion. At least one of a chilling element and a heating element incorporated into the base. The top surface may comprise a raised feature configured to mate with a cavity within the bottom surface of the decanter. A top surface of the base may comprise a rounded cone shape. A majority of the base may be configured to fit within a cavity in a lower surface of the decanter.

According to an aspect of the disclosure, a wine decanter pedestal system may comprise a wine decanter pedestal having a housing comprising a base configured to be supported by at least one foot above a surface upon which the wine decanter pedestal is placed, the base having a base center axis and a ledge surrounding a top surface and extending outward from the top surface, the ledge configured to support a bottom surface of a decanter placed on the top surface, a rotary motor positioned below the base and having a rotary drive configured to output a torque, the rotary drive operably coupled to the base at an attachment point off-center from the base center axis such that rotation of the rotary motor causes the base to turn in circular spin motion and the base center axis to orbit about the rotary drive in a circular orbital motion, a weight sensor operably coupled to the base and configured to measure a weight of a decanter when placed upon the base, and a controller enclosed within the wine decanter pedestal, the controller configured to automatically adjust the torque of the rotary drive in response to the weight measured by the weight sensor to increase torque for heavier weights measured and decrease torque for lighter weights measured.

Particular embodiments may comprise one or more of the following features. A footprint area of the decanter may be greater than a footprint area of the wine decanter pedestal. The footprint area of the decanter may be greater than twice the footprint area of the wine decanter pedestal. At least one of a chilling element and a heating element incorporated into the base. The top surface may comprise a raised feature configured to mate with a cavity within the bottom surface of the decanter. A top surface of the base comprises a rounded cone shape. A majority of the base may be configured to fit within a cavity in a lower surface of the decanter.

According to an aspect of the disclosure, a wine decanter pedestal system may comprise a wine decanter pedestal having a housing comprising a base configured to be supported by at least one foot above a surface upon which the wine decanter pedestal is placed, the base having a base center axis, and a rotary motor positioned below the base and having a rotary drive configured to output a torque, the rotary drive operably coupled to the base at an attachment point off-center from the base center axis such that rotation of the rotary motor causes the base to turn in circular spin motion and the base center axis to orbit about the rotary drive in a circular orbital motion.

Particular embodiments may comprise one or more of the following features. A weight sensor may be operably coupled to the base and configured to measure a weight of a decanter when placed upon the base. A controller within the housing, the controller configured to automatically adjust the torque of the rotary drive in response to the weight measured by the weight sensor to increase torque for heavier weights measured and decrease torque for lighter weights measured. A ledge surrounding a top surface and extending outward from the top surface, the ledge configured to support a bottom surface of a decanter placed on the top surface. A switch operably coupled to the base and configured to stop rotational movement of the motor in response to a decanter being removed from the base and start rotational movement of the motor in response to a decanter being placed on the base.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

The invention will hereinafter be described in conjunction with the appended drawings, where like designations denote like elements, and.

Figure 1:
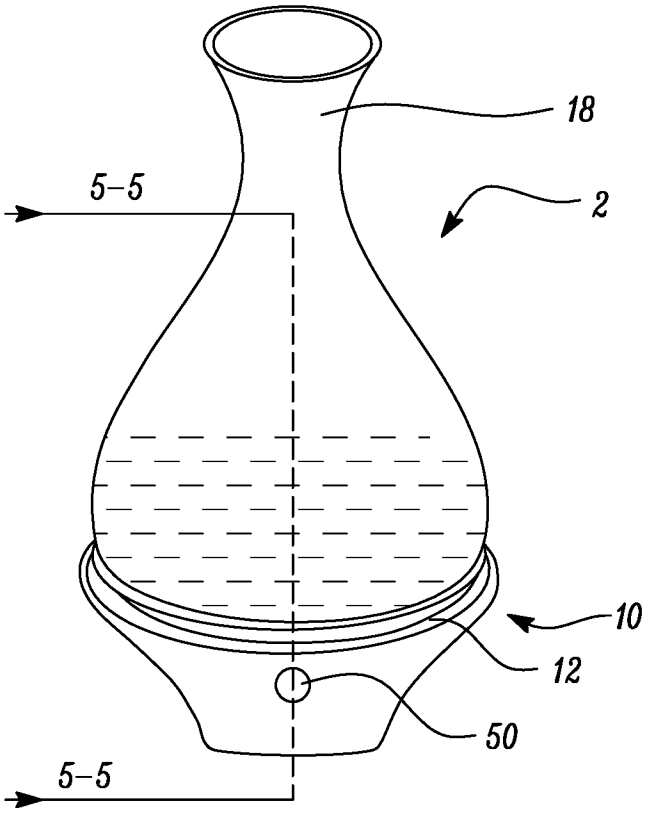
FIG. 1 is a perspective view of one implementation of a wine decanter pedestal with a wine decanter placed on top.
Figure 2:
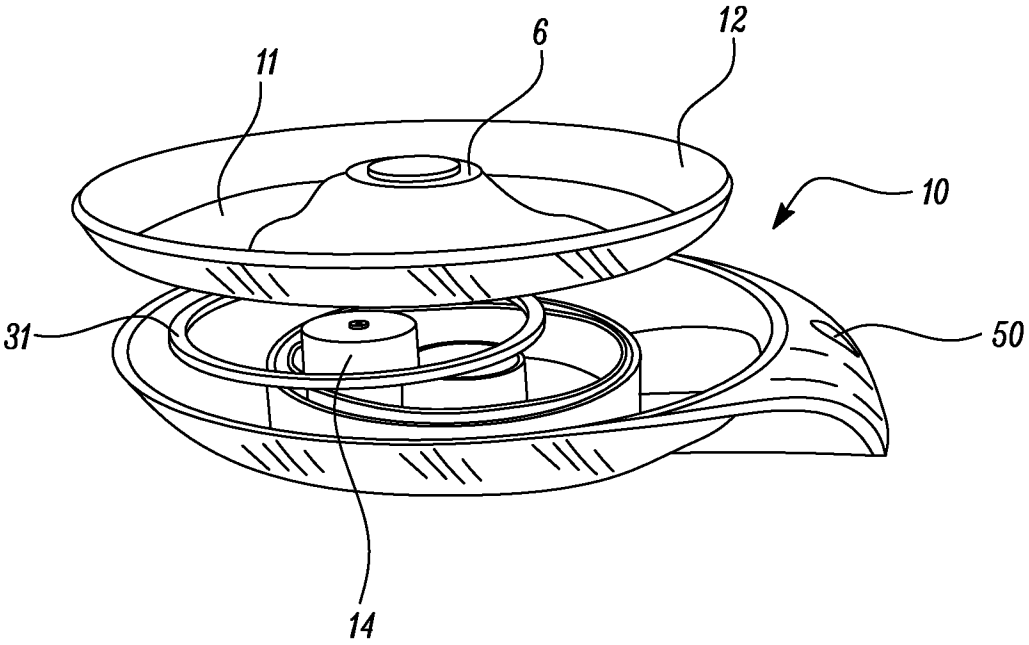
FIG. 2 is a perspective view of the wine decanter pedestal illustrated in FIG. 1 with the base raised to show the motor.
Figure 3:
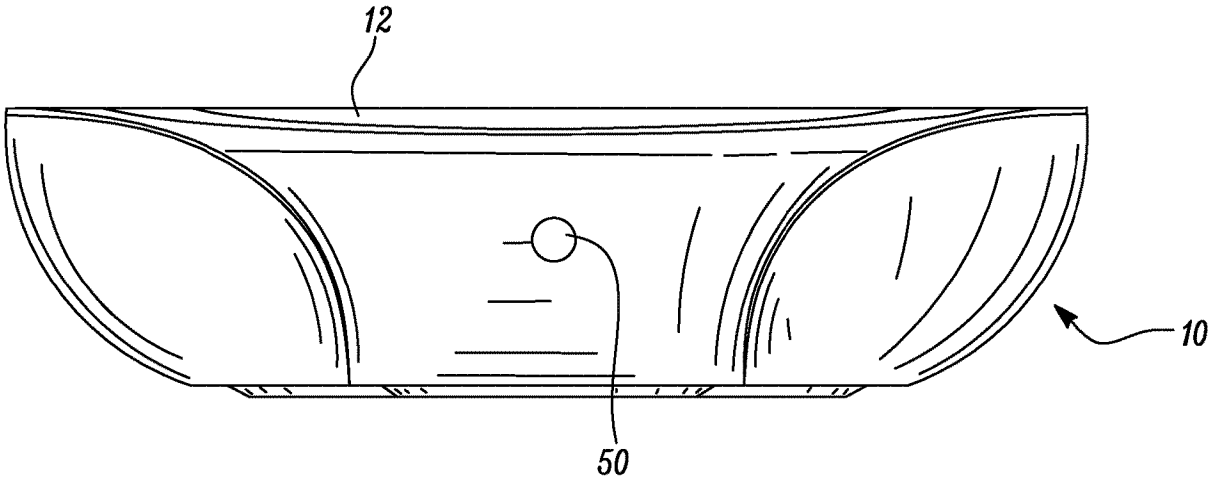
FIG. 3 is a front view of the wine decanter pedestal illustrated in FIG. 2.
Figure 4:
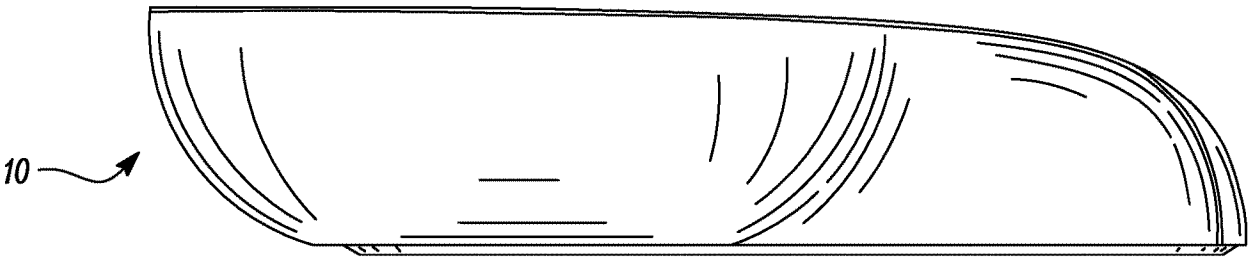
FIG. 4 is a side view of the wine decanter pedestal illustrated in FIG. 2.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure relates to wine decanter pedestals with a motor and control system configured to controllably vary the swirl motion of the decanter pedestal to swirl the wine stored on the pedestal. Each variety and vintage of wine has an optimal swirl rate and duration. For example, slow swirl movements of shorter duration is generally needed for more mature red wines which need to be handled with a very high level of precision to protect the wind from overexposure to oxygen which might spoil the wine's natural characteristics. Younger wines need a faster swirl and longer duration for additional duration to maximize the wine's natural flavor potential.

FIGS. 1-9 illustrate an example of a wine decanter pedestal system housing 2 with a motorized swirl is disclosed that includes a pedestal 10 with a swirling/spinning base 12, a rotary motor 14 in the base 12 that may be battery powered or corded, a controller 16 (discussed more below), and an input or receiver or transceiver 24. Although it is not required for aeration, particular embodiments of a decanter 18, formed of a neutral material such as glass or crystal, may include a mating feature 8 in the decanter base 4 that mates with a rotary drive 6 on the pedestal base 12 for improved performance and safety.

Figure 10:
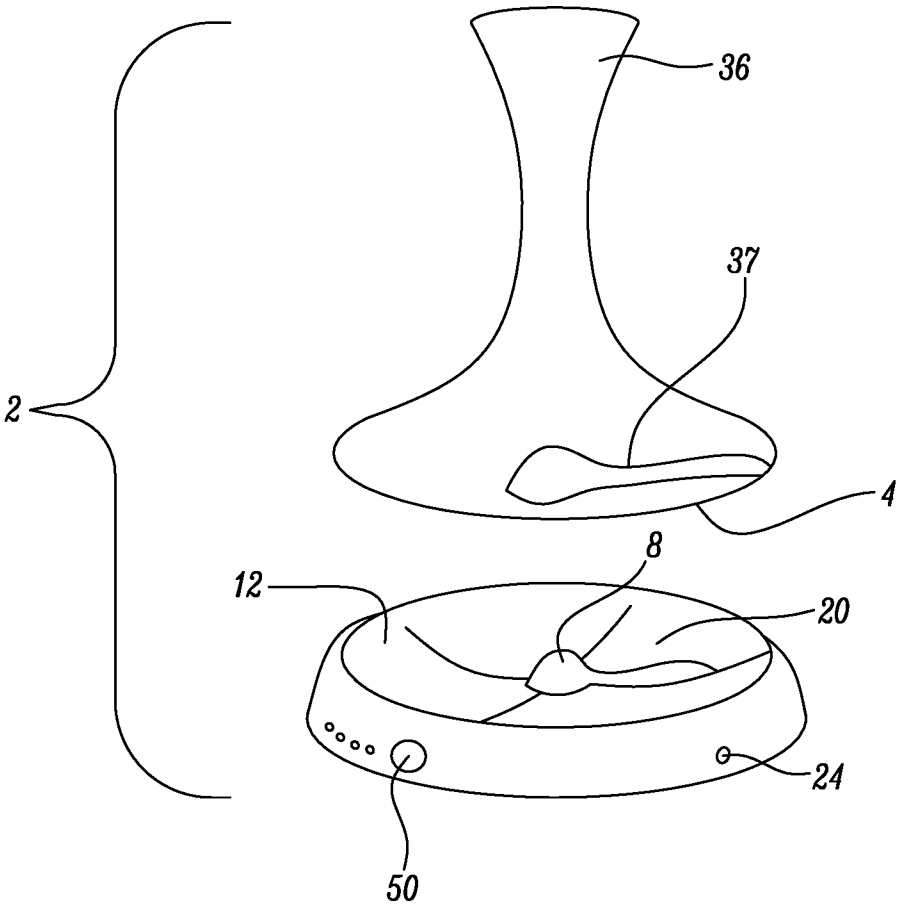
FIG. 10 is a perspective view of a second implementation of a wine decanter pedestal with a paddle feature on the decanter mount.
Figure 11:
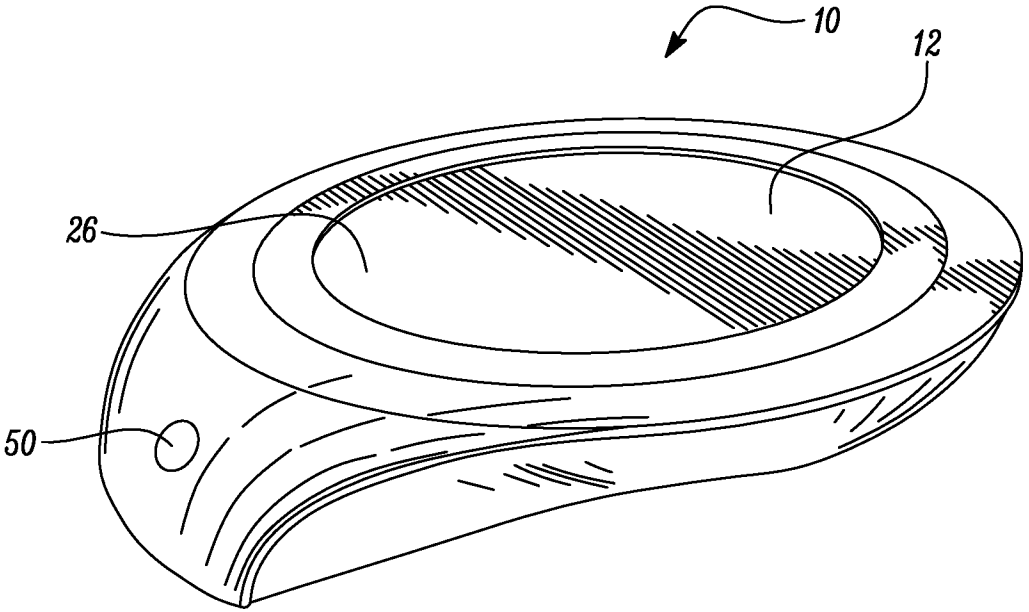
FIG. 11 is a perspective view of a third implementation of a wine decanter pedestal with a flat base.
Figure 12:
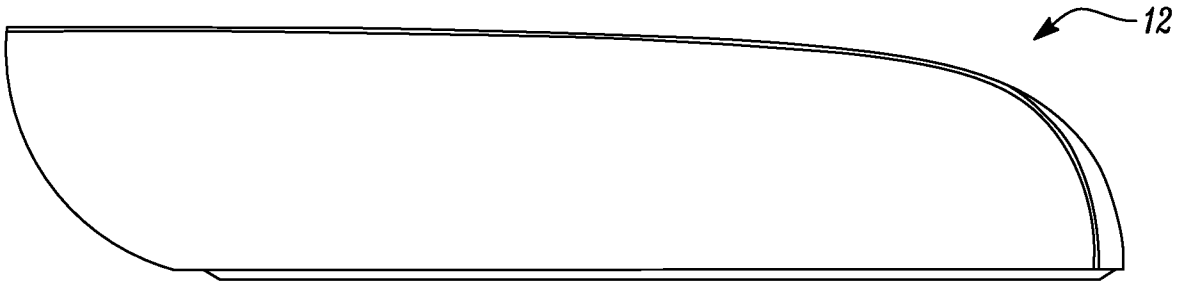
FIG. 12 is a side view of the wine decanter pedestal of FIG. 11.
Figure 14:
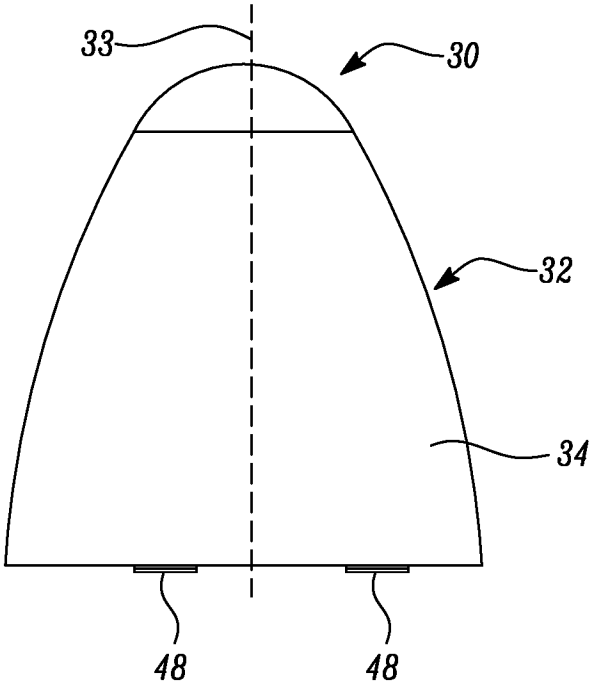
FIG. 14 is a side view of the wine decanter pedestal of FIG. 13.

The controller 16, which is electrically coupled to the motor 4, configured to set and vary the motor 14 speed and duration, spinning about its central axis 15, so as to cause wine in the decanter 18 to swirl around in a way in the decanter 18 to better expose the e 19 in the decanter 18 to oxygen in the air. Although in most implementations, the mating feature 8 in the decanter base 4, with base center axis 3, is centered to the decanter 18, with decanter center axis 17, to enhance the swirling motion and permit consistent wave patterns in the wine 19 swirling in the decanter 18, in particular embodiments, such as that illustrated in FIG. 10, the mating feature 8 in the decanter base 4 includes not only a centered raised mating feature 8, but also a side mating feature in the form of a paddle 20, off-center with the decanter to disrupt the swirling wine wave form within the decanter for embodiments where additional disruption of the wine wave pattern is desired. The optional paddle feature 20 is shaped to disrupt the flow of wine as it swirls over the paddle 20, thereby enhancing the aeration of the wine with fewer swirls. Some embodiments, like those illustrated in FIGS. 11 and 12, do not include any mating feature 8, but instead include a flat upper surface 26 of the pedestal base 12. Whether the pedestal base 12 includes one or more raised mating features 8, the upper surface 26 of the pedestal base 12 may include a friction enhanced surface to reduce the likelihood of the decanter 18 shifting its position on the pedestal base 12 as the base 12 goes through its swirling motion. The friction enhanced surface may become friction enhanced through methods known in the art including, but not limited to, coating the surface 26 with a rubberized or foamed material and/or adding a texture to the surface 26. The surface coating and/or texturing needed will depend upon the weight and outer surface texture of the decanter and the weight of the wine within the decanter, and the force applied to the motor. Those of ordinary skill in the art will understand an appropriate coating type for their particular application given this disclosure.

The pedestal 10 may further include a liquid drain 11 through which liquid spilled on the base 12 drains to avoid the motor 14 and any electronics within the pedestal 10 from getting wet or sticky. In particular embodiments, the base 10 may further comprise a chilling or heating element 13 incorporated into the base 10 to chill or heat the decanter to bring a wine to a desired temperature and maintain it there.

Figure 5:
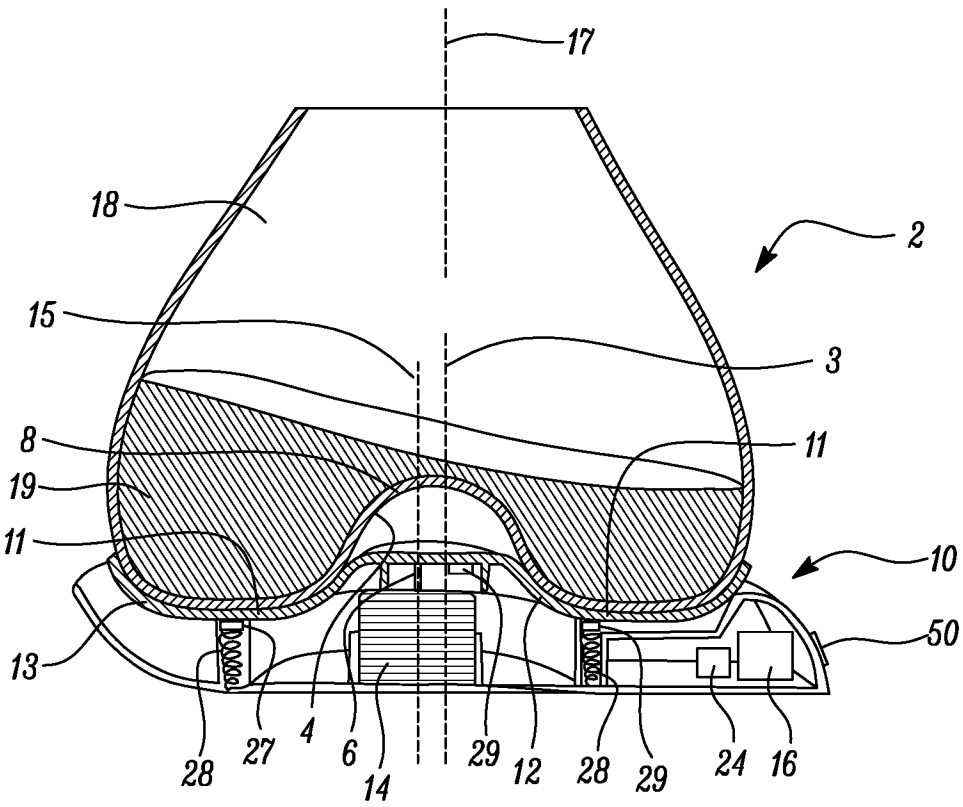
FIG. 5 is a cross-sectional view of the wine decanter pedestal of FIG. 1 taken along section lines 5-5.
Figure 6:
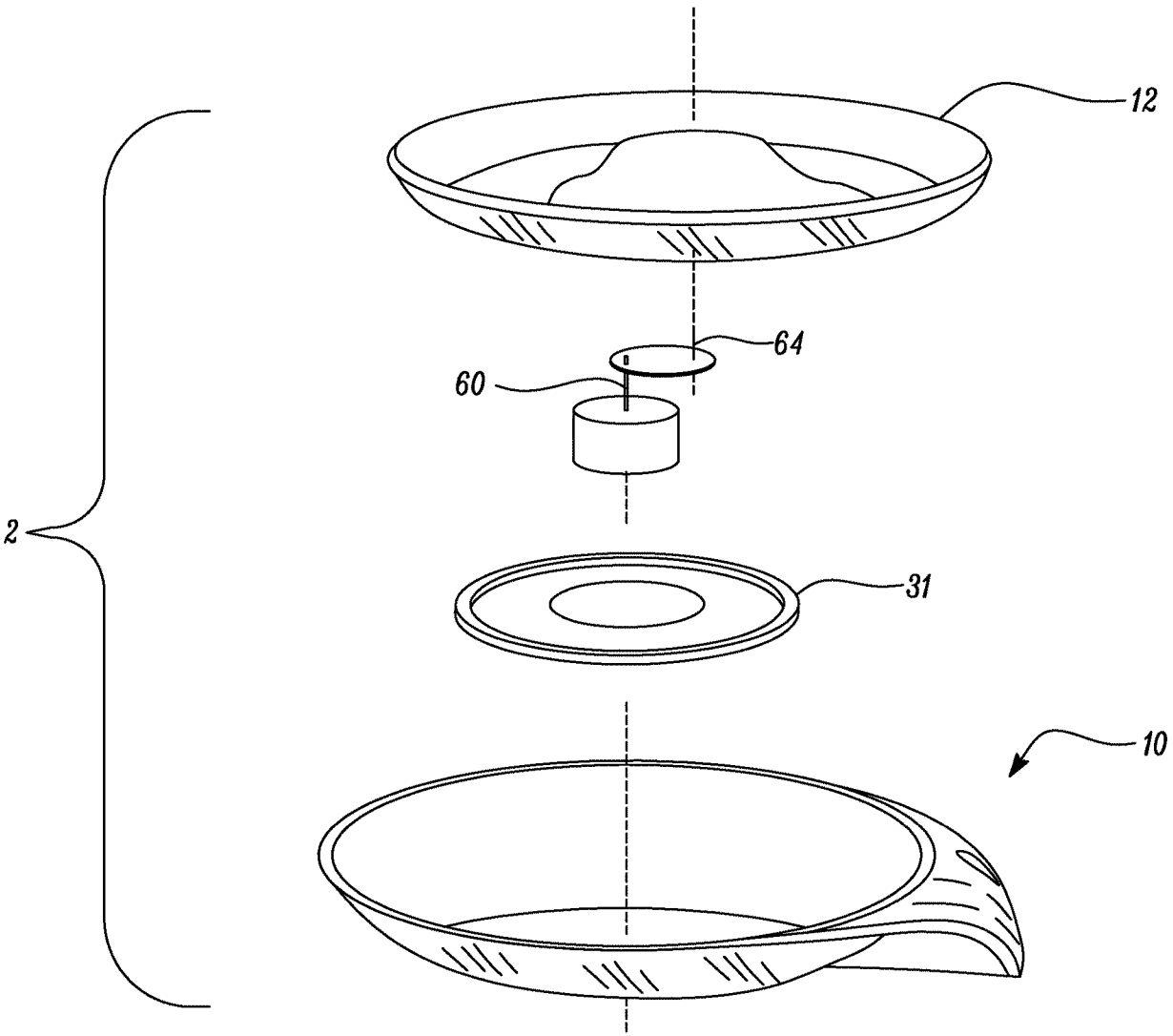
FIG. 6 is an exploded view of the wine decanter pedestal illustrated in FIG. 3.
Figure 7:
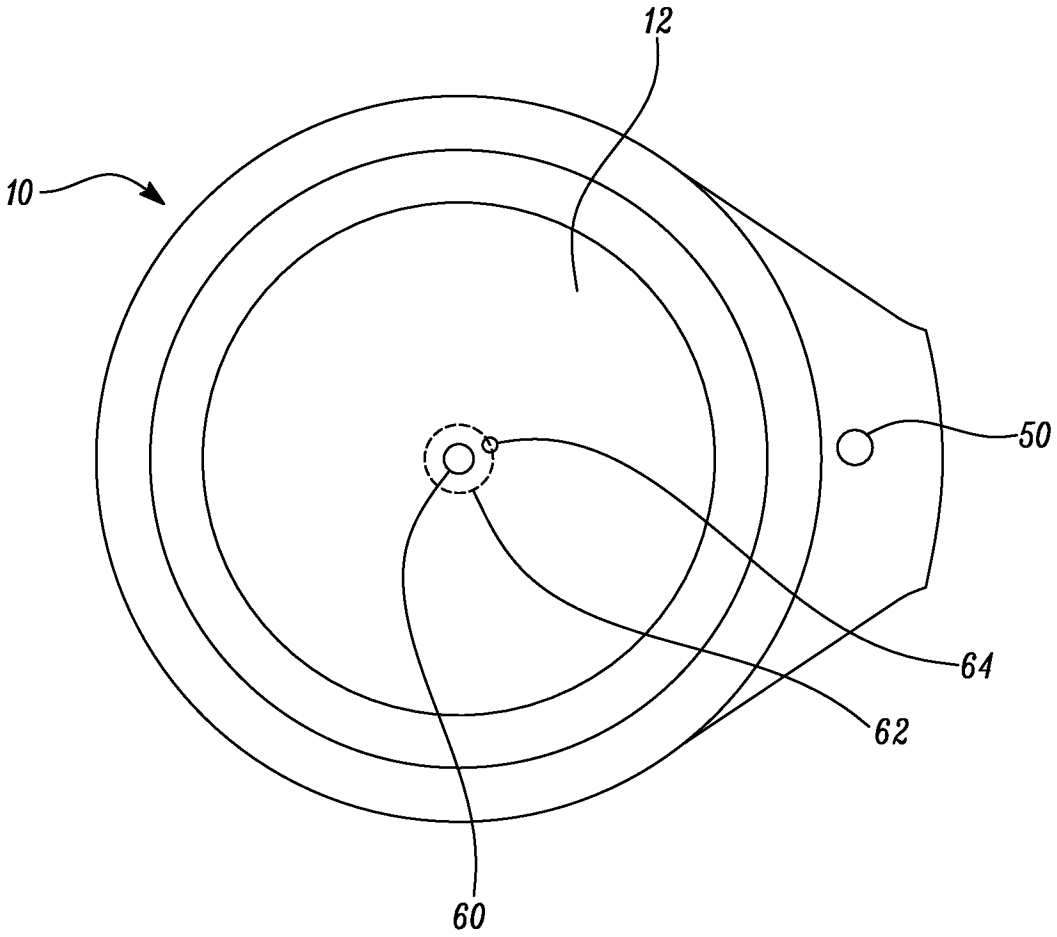
FIG. 7 is a top view of the wine decanter pedestal illustrated in FIG. 3.
Figure 8:
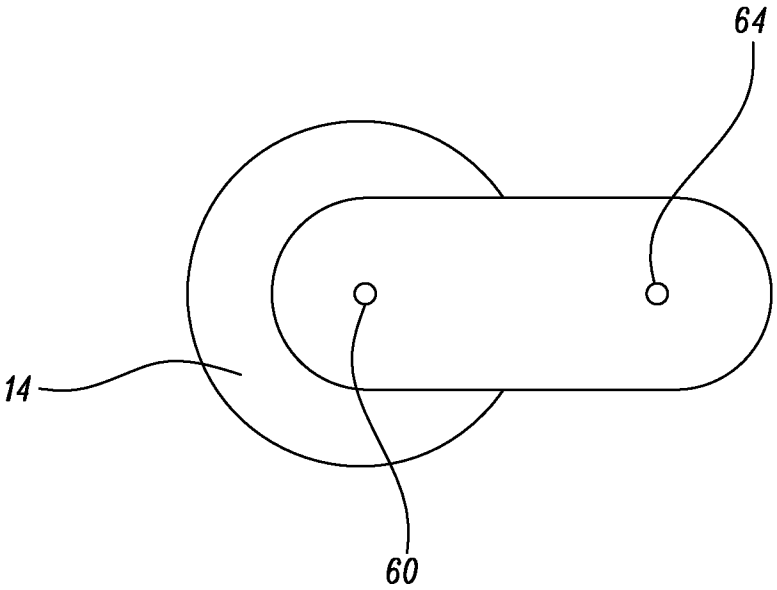
FIG. 8 is a top view of the motor illustrated in FIG. 5.
Figure 9:
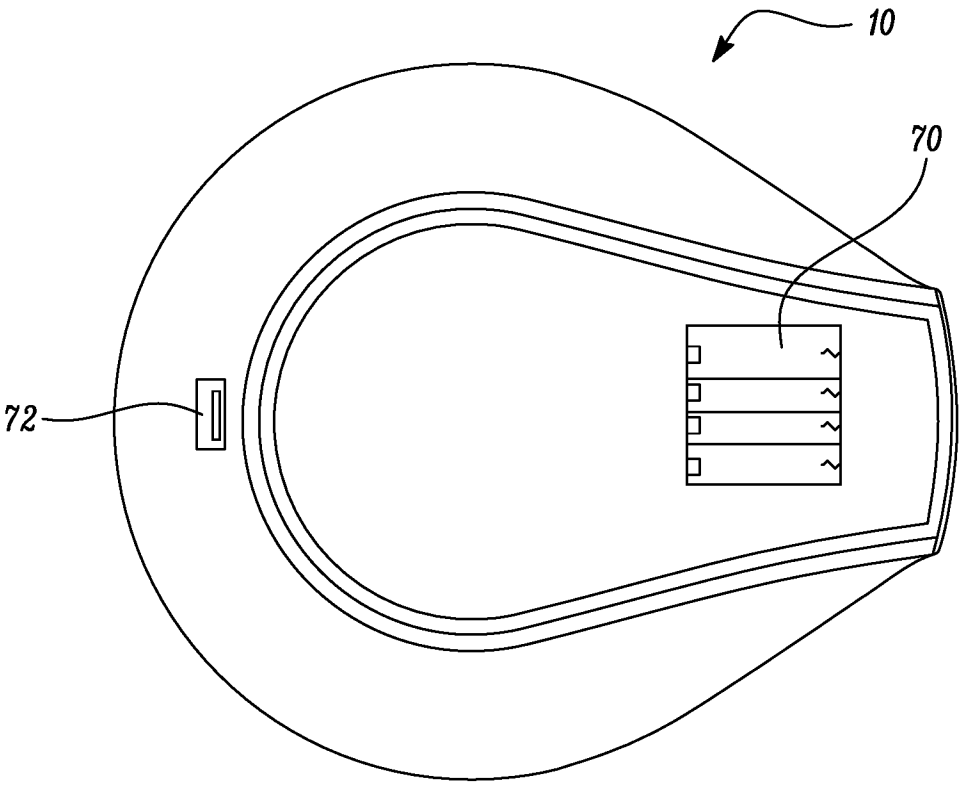
FIG. 9 is a bottom view the wine decanter pedestal illustrated in FIG. 3.

FIG. 5 illustrates a cross-sectional image of the wine decanter pedestal system housing 2 of FIGS. 1-9, taken along section line 5-5 of FIG. 1 and illustrating the controller 16, wireless receiver 24, and motor 14. In addition, pressure sensors 27 are positioned below the base 12 to sense when a decanter 18 is placed upon the base 12, and when it is removed. The motor 14, responsive to pressure applied to or released from the pressure sensors 27, activate or deactivate the motor 14, either through the controller 16 or through directly opening and closing a power switch to the motor 14. Springs 28 bias the pressure sensors and base 12 upward. When a decanter is sensed through the pressure sensors 27 on the base 12, in this first embodiment, the motor 14 begins providing a circular orbital motion to the base 12 by spinning off-center of the decanter. A pressure sensor support 31 provides an even balance on the pressure sensors 27 for the base 12 (FIG. 6). FIG. 7 illustrates a rotary drive 60 for the motor 14 and an orbital path 62 for the attachment point 64 between the motor 14 and the base 12. FIG. 8 illustrates the motor 14, the rotary drive 60 for the motor 14, and the attachment point 64 to attach the motor 14 to the base 12. As the motor spins, the attachment point 64 rotates around the motor 14 to cause the attachment point 64, and the respective portion of the base 12, to orbit the motor's 14 rotary drive 60. This circular orbital motion of the base 12 disrupts the stationary wine in the decanter 18 causing it to begin to swirl within the decanter 18. Using the two axes to cause the circular orbital motion assists in creation of the aerating wave within the decanter. Batteries may be used to power the wine decanter pedestal system by inserting them into a battery port 70, or a power port 72 may be used to plug the system directly into a USB or other power supply.

In an alternate embodiment of the wine decanter pedestal system, the rotary drive 60, aligned with the motor center axis 15 may be coupled to the base 12 directly or through a series of gears, but off-center, as with attachment point 64, so that the rotation of the motor causes not only the circular orbital motion of the base 12, but also a circular spin motion to the base 12. Thy the decanter 18 both orbiting d spinning, like the earth both orbiting the sun and spinning on its axis, the disruption to the wine within the decanter 18 is enhanced, the wave form is enhanced, and exposure of the wine to the air within the decanter 18 is also enhanced.

A weight sensor 29, either positioned below the base 12 or incorporated into the pressure sensors 27, senses a weight of the decanter and its contents. Responsive to the weight sensed by the weight sensor 29, the controller 16 adjusts the power supplied to the motor 14 to adjust the force applied to the motor 14 and, thus, the speed at which it rotates. As the weight of the decanter 18 decreases (as wine is dispensed into glasses), less force is applied by the motor automatically to adjust to the lowered weight to maintain a regulated control of the swirling motion and disturbance for the wine to establish a desired swirl wave. When the weight of the decanter increases, for example when a different decanter is placed on the surface or additional wine is added to the decanter 18, the controller 16 automatically adjusts the force applied to the motor 14. In this way, the rotational speed of the motor 14 and swirling motion of the decanter wine 19 can be kept fairly consistent despite changes in the weight of the decanter on the base 12 to reduce the likelihood that the wine will slosh or that the appropriate speed for the desired waveform will be lost by over- or under-powering the motor for a particular decanter weight. In particular embodiments, a control chip associated with the motor will automatically adjust this rotation speed and force exerted by the motor.

Different from other embodiments, the embodiments illustrated in relation to FIGS. 13-17 include a wine decanter pedestal system 30 with a base 32 with a housing 34 shaped and sized to fit either entirely within the footprint area (represented in FIG. 15 by diameter 35) of the decanter 36 or, in some embodiments, within less than half of the footprint area of the decanter 36 so that it appears upon casual view as though the decanter 36 is floating above the surface upon which it rests and is swirling on its own. A majority of the wine decanter pedestal system 30 of these embodiments fits within a cavity 37 within a bottom surface of the decanter 36, and wine 38 within the decanter 36 swirls around the cavity 37.

Figure 13:
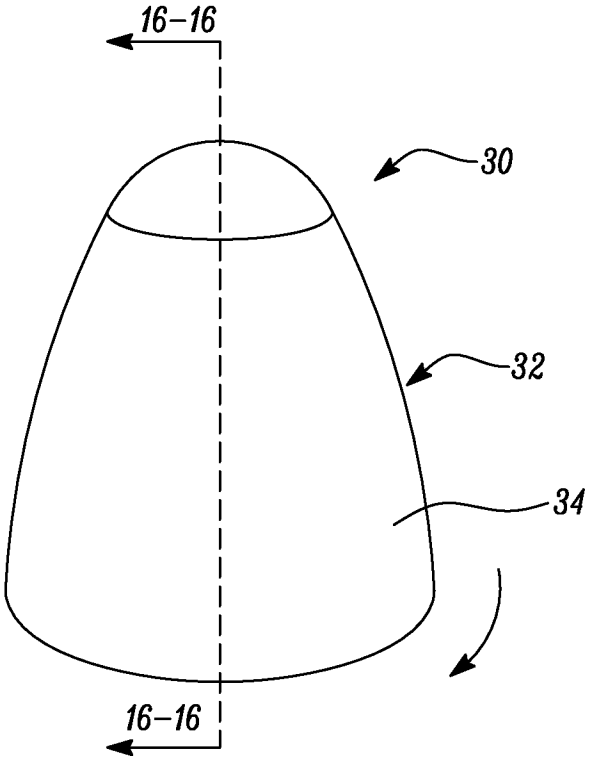
FIG. 13 is a perspective view of a fourth implementation of a wine decanter pedestal.
Figure 15:
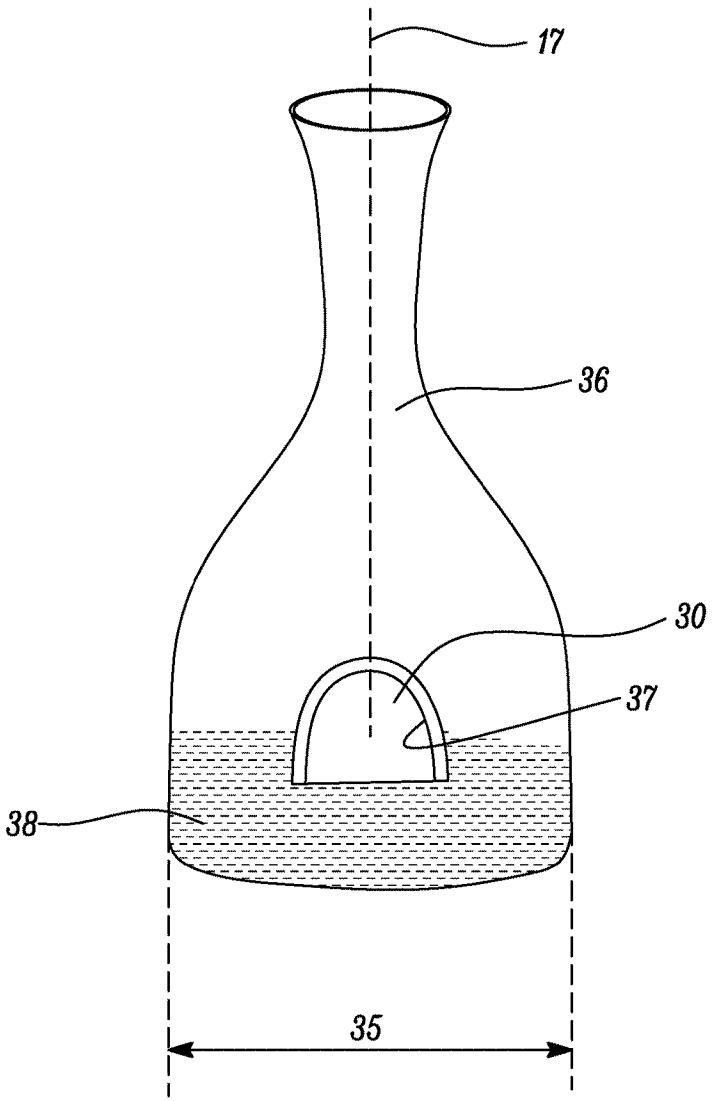
FIG. 15 is a perspective view of a wine decanter pedestal system using the wine decanter pedestal of FIG. 13.
Figure 16:
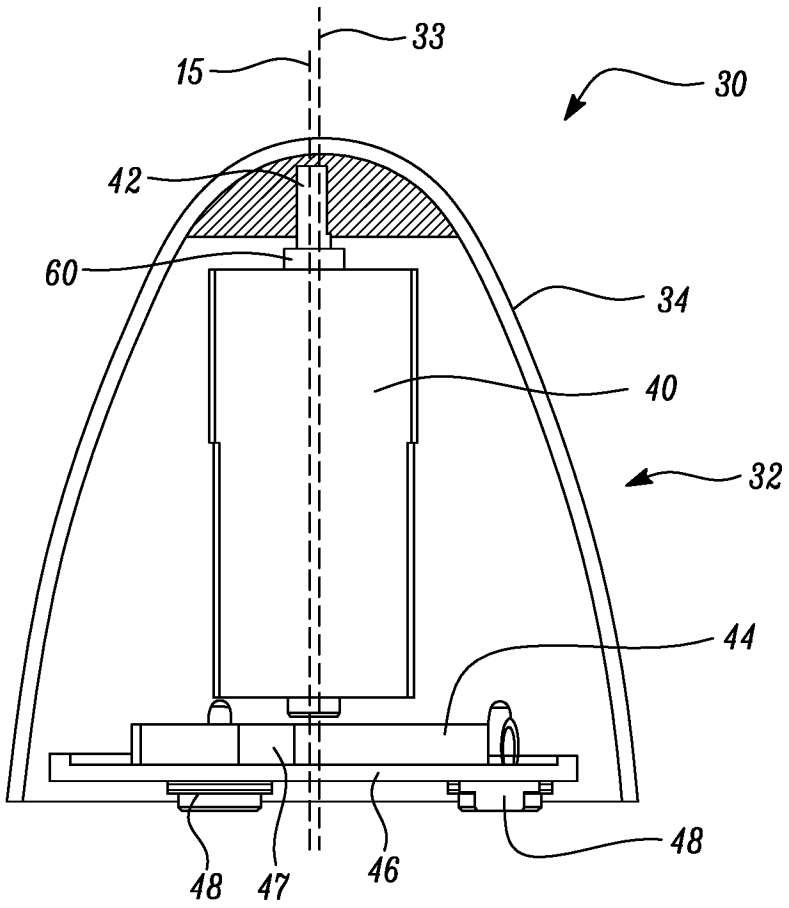
FIG. 16 is a cross-sectional view of the wine decanter pedestal of FIG. 13 taken along section lines 16-16.

FIG. 16 illustrates a cross-sectional view of the wine decanter pedestal system 30 of FIG. 13 taken along section line 16-16. As illustrated for this particular embodiment, the housing 34 is formed as an outer shell for the unit with the remainder of the wine decanter pedestal system 30 housed beneath the housing 34. The motor 40 is coupled to the base 32 through a motor mount 42 that is rotationally coupled to the rotary drive 60 that is off-center on the base 32 so that the outer shell rotates about the base off-center. In a particular embodiment, it rotates off-center by about 0.5 inches. Other quantities of off-center mounting, larger or smaller, are also contemplated including anywhere from 0.25"-1", depending upon the particular size of decanter used and the particular implementation for the base. The 0.5 inch offset worked well for a 1 liter wine flask in this embodiment. Additionally, or alternatively, the mounting arm may be formed to be stiff, with minimal bend, or more flexible, with a greater bend as it rotates, to add wobble to the rotation of the outer shell about the support base for the device.

A weight sensor 44 in the form of a load cell supports the motor and senses the weight of pressure applied against the base 32 by the decanter 36. This weight sensor 44 also causes the motor 40 to turn on when a weight is applied, and turn off when a weight is removed from the base 32. The automated off/on swirl feature allows the user to fill up the decanter and set it on the base which then automatically starts swirling the wine as the pedestal system senses higher load factor. Once the user takes the decanter off the pedestal, the pedestal stops swirling automatically.

The motor 40 turning on and off and the wine decanter pedestal system 30 automatically adapting the force applied to the rotary motor 40 in response to changes in the weight of a decanter placed on top of the base 32 operates the same as described in relation to previous embodiments. Furthermore, the connection between the motor 40 and the base 32 may be configured the same as the embodiment described in relation to FIG. 7 so that the base orbits around the rotary drive of the motor 32. However, in the particular embodiment illustrated in FIG. 16, the motor 40 not only causes the base 32 to orbit around the motor 40, offset to cause the swirling wave of wine 38 within the decanter 36, the motor 40 is also fixedly coupled to the base 32 so that the base 32 spins in a circular spin motion in addition to orbiting the motor. Because the wine decanter pedestal system 30 is seated within a cavity 37 within the base of the decanter 36, this spin also causes the decanter 36 to spin and enhance the wave form for the wine 38 within the decanter 36. Varying the speed and/or direction of the swirling pedestal base establishes a varying momentum and greater disruption between the decanter 36 sides and the wine 38 to increase the exposure of the wine to the air. By creating a repeatable swirl motion that mimics the natural swirl movements of a user swirling the wine in a wine glass, with intermittent swirls at variable speeds, the aeration of the wine can be optimized.

By mounting the motor 40 to the base 32 off-center and allowing the base 32 to spin as well as orbit, both the spinning and the orbital movement are handled with a single axis as opposed to the two axes of the previous embodiments. Varying the orbital and spin accelerations, wave motion can be developed at various speeds, slow and fast, and various automatically configured forces applied by the motor 32. Conventional approaches to wave creation in wine swirling focus on physical parameters, like diameter, to determine the constant angular speed necessary to create a wave. Because the wave in the wine is a result of a disturbance, changing acceleration will cause a disturbance no matter the speed and will create a wave. Through use of the sensed weight received from the weight sensor 44, the controller 46 is configured to create variations in the orbital and spin acceleration to change the acceleration of the angular speed, thus creating waves at various angular velocities. In particular embodiments, use of the motor 40 includes automatically changing the speed of the motor 40, and automatically changing the orbital acceleration and/or the spin acceleration caused by the motor 40.

In operation, the weight sensed by the weight sensor 44 is communicated to the controller 46, which is in electronic communication with the weight sensor 44. Rubber or plastic feet 48 are used to support the wine decanter pedestal system 30 from beneath the base 32. The controller 46, which is supported by the feet 48, supports the weight sensor 44, which in turn supports the motor 40 to which the base 32 is mounted. When a decanter 36 is sensed on the base 32, the motor 40 activates according to the pattern and force indicated by the controller 46.

As illustrated in FIG. 16, a mounting arm couples the outer shell to the motor through a bracket on the shaft. In one particular embodiment, the gear motor is configured with a 5 Kgm torque using 5 Vdc and 500 mA with an operating range of 30 to 90 rotations/minute (RPM) controlled through a change in the voltage applied. In another particular contemplated embodiment, the operating range is 30 to 120 RPM. In another particular contemplated embodiment, a 12V power supply or 12V battery is used. A custom battery pack, or even a circular lithium ion battery, may be included within the outer shell as well and charged through a power connection port on a bottom surface of the unit. In a particular embodiment, a base 32 includes a bottom diameter of about 70 mm and a top diameter of about half of the bottom diameter, with the top domed. A 3.3V DC 850 mAh rechargeable battery 47 is used within the base 32 to power a motor that has about a 25 mm diameter and stands about 53 mm tall. The height and width of the motor is not critical to operation and in particular embodiments, it is contemplated that larger diameter and smaller height motors will be used to reduce the size of the cavity within the decanter. The decanter is between 125 mm to 260 mm in diameter at the bottom of the decanter with a height within the range of 32 mm to 75 mm tall. During the swirling action of the base 32, a lot of the wine volume and weight is moved outward in the decanter, toward the outer sides, providing additional lateral forces to the base 32 and to the stability of the decanter 36 resting on the base 32.

Figure 17:
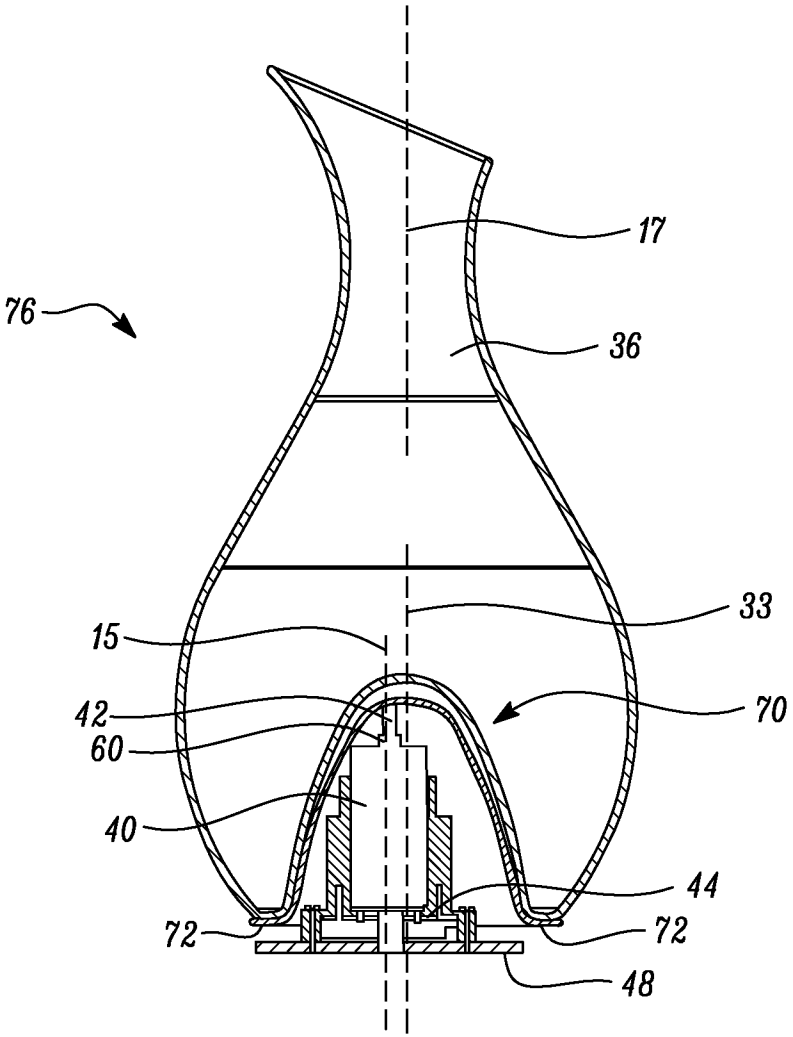
FIG. 17 is a cross-sectional view of a fifth implementation of a wine decanter pedestal system taken along the same cross-sectional view as FIG. 16.

FIG. 17 illustrates another slight modification to FIG. 16, but with all of the same functionality and operation. The difference between FIGS. 16 and 17 is that in FIG. 17, the base 70 includes a ledge 72 extending outward from the base at a bottom edge of the base 70. The ledge 72 supports the bottom of the decanter 36 to help stabilize the decanter 36 as it swirls. By adding a ledge 72, the manufacturing tolerances between the decanter 36 cavity 37 and the outer surface of the base 70 can be more relaxed without the decanter 36 wobbling. Additionally, the at least one support foot 48 in FIG. 17 are merged or enlarged into an enlarged support foot 48 for more stable support. Still, however, in particular embodiments, the wine decanter pedestal system 76 is within the footprint of the decanter 36 so that to a casual observer, the wine decanter 36 is swirling by itself slightly above the surface upon which it rests.

For any embodiment disclosed herein, the controller 16, 46 may be configured to receive user input through a separate receiver 24, or one incorporated on the controller 16, 46 circuit board to direct the controller 16, 46 to set the selected pattern for powering the motor 14, 40. The pattern selected by the user, whether through pre-determined fixed settings or through customized user settings, determines how fast the base 12, 32 will swirl, for how long, and how the variations in the swirling and durations will occur. The controller 16, 46 input 50 may simply comprise a button that allows the user to progress through pre-determined, fixed settings for the swirl pattern by sequentially pressing the button as the controller cycles through the pre-set patterns. LED indicators may be included to indicate the particular pre-set pattern chosen. In this way, the user can select from among the programs for the type of wine placed in the decanter. The pre-set patterns may be configured to correspond to programs for different wines, corresponding to the need for different levels of aeration.

It is anticipated for any embodiment disclosed herein, that aside from basic on/off controls and possibly a mode selector control on the device, the controller may be controlled by a mobile phone app communicating with the receiver 24 through Bluetooth or other wireless communication methods. The phone app may be associated with a wine database service, such as Vivino (Vivino.com), that includes a large database of wine varieties, grape specimens, and vintages. As part of the application, the user can enter the specific wine characteristics (using characteristics such as vintage, type, alcohol level, winery, manufacture method, quantity or even as basic as the basic wine characteristics of sweetness, acidity, tannin, alcohol and body, or even others such as temperature and use). Any characteristics may be used to assist the controller in determining an appropriate rate and duration of rotational motion for the base motor to move the base about its support. Further, the database may include or have associated with it characteristics of the wine to allow the app to calculate, or have pre-stored in the database, the pre-determined optimal swirling characteristics for the base 12, 32 so that a user can enter the wine into the app and select the swirling pattern optimal for their wine. For example, when the user selects a wine, i.e. merlot vintage 1995, the app receives the input, either through direct or voice entry, or through the user scanning the UPC or other code on the wine bottle, and the app recommends a special aeration optimization program for the merlot, making the process very simple for the consumer to have their wine optimized without the risk of over or under oxygen exposure. In particular embodiments, the user can override or customize the special aeration optimization program if desired. The app communicates the settings to the controller 16, 46 for the swirling motion for the base 12, 32.

The force exerted by the motor may even be adapted to adjust for the weight of the decanter filled by a wine with particular characteristics so that less energy is applied for a particular wine to cause less disturbance and agitation. In particular embodiments, the circuit on the circuit board will measure the load of the motor with the filled decanter to determine what energy is required for the motor to establish and maintain its desired rotation rate. Those of skill in motor technologies will understand how to monitor the rate/speed of the motor and adjust the energy applied to the motor to maintain the desired rate/speed of rotation. Once the characteristics or identity of the wine are input into the control application, the application, using associated data tables, can determine an appropriate rate/duration for rotating the wine in the decanter to improve the user experience.

It will be understood that implementations of a variable force wine decanter base are not limited to the specific assemblies, devices and components disclosed in this document, as virtually any assemblies, devices and components consistent with the intended operation of a variable force wine decanter base. Accordingly, for example, although particular variable force wine decanter bases, and other assemblies, devices and components are disclosed, such may include any shape, size, style, type, model, version, class, measurement, concentration, material, weight, quantity, and/or the like consistent with the intended operation of a variable force wine decanter base. Implementations are not limited to uses of any specific assemblies, devices and components; provided that the assemblies, devices and components selected are consistent with the intended operation of a variable force wine decanter base.

Accordingly, the components defining any variable force wine decanter base implementations may be formed of any of many different types of materials or combinations thereof that can readily be formed into shaped objects provided that the components selected are consistent with the intended operation of an electrical box assembly comprising an adjustable voltage divider implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various variable force wine decanter bases may be manufactured using conventional procedures as added to and improved upon through the procedures described here. Some components defining a variable force wine decanter base may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that use of a variable force wine decanter base is not limited to the specific order of steps as disclosed in this document. Any steps or sequence of steps of the assembly of a variable force wine decanter base indicated herein are given as examples of possible steps or sequence of steps and not as limitations, since various assembly processes and sequences of steps may be used to assemble a variable force wine decanter base. The implementations of the variable force wine decanter bases described are by way of example or explanation and not by way of limitation. Rather, any description relating to the foregoing is for the exemplary purposes of this disclosure, and implementations may also be used with similar results for a variety of other applications requiring a variable force wine decanter base.

What is claimed is:

1. A wine decanter pedestal system, comprising:

a wine decanter pedestal having a housing comprising a base configured to be supported by at least one foot above a surface upon which the wine decanter pedestal is placed, the base having a base center axis and a ledge surrounding a top surface and extending outward from the top surface, the ledge configured to support a bottom surface of a decanter placed on the top surface;

a wireless receiver operatively coupled with the control input, the wireless receiver configured to receive wireless commands from a wireless device;

a rotary motor positioned below the base and having a rotary drive parallel to the base center axis, the rotary motor configured to output a torque through the rotary drive, the rotary drive operably coupled to the base at an attachment point off-center from the base center axis such that rotation of the rotary motor causes the base center axis to orbit about the rotary drive in a circular orbital motion;

a weight sensor operably coupled to the base and configured to measure a weight of a decanter when placed upon the base;

a controller enclosed within the wine decanter pedestal, the controller operably coupled to the wireless receiver, the rotary motor and the weight sensor, the controller configured to automatically adjust the torque of the rotary drive in response to the weight measured by the weight sensor to increase torque for heavier weights measured and decrease torque for lighter weights measured.

2. The wine decanter pedestal system of claim 1, further comprising the decanter, and wherein a footprint area of the decanter is greater than a footprint area of the wine decanter pedestal.

3. The wine decanter pedestal system of claim 2, wherein the footprint area of the decanter is greater than twice the footprint area of the wine decanter pedestal.

4. The wine decanter pedestal system of claim 1, wherein the rotary drive is rotationally coupled to the base and configured to transfer rotational motion of the rotary drive to the base such that rotation of the rotary motor causes the base to experience circular spin motion in addition to the circular orbital motion.

5. The wine decanter pedestal system of claim 1, further comprising at least one of a chilling element and a heating element incorporated into the base.

6. The wine decanter pedestal system of claim 2, wherein the top surface comprises a raised feature configured to mate with a cavity within the bottom surface of the decanter.

7. The wine decanter pedestal system of claim 1, wherein the top surface of the base comprises a rounded cone shape.

8. The wine decanter pedestal system of claim 2, wherein a majority of the base is configured to fit within a cavity in a lower surface of the decanter.

9. A wine decanter pedestal system, comprising:

a wine decanter pedestal having a housing comprising a base configured to be supported by at least one foot above a surface upon which the wine decanter pedestal is placed, the base having a base center axis and a ledge surrounding a top surface and extending outward from the top surface, the ledge configured to support a bottom surface of a decanter placed on the top surface;

a rotary motor positioned below the base and having a rotary drive configured to output a torque, the rotary drive operably coupled to the base at an attachment point off-center from the base center axis such that rotation of the rotary motor causes the base to turn in circular spin motion and the base center axis to orbit about the rotary drive in a circular orbital motion;

a weight sensor operably coupled to the base and configured to measure a weight of a decanter when placed upon the base;

a controller enclosed within the wine decanter pedestal, the controller configured to automatically adjust the torque of the rotary drive in response to the weight measured by the weight sensor to increase torque for heavier weights measured and decrease torque for lighter weights measured.

10. The wine decanter pedestal system of claim 9, further comprising the decanter, and wherein a footprint area of the decanter is greater than a footprint area of the wine decanter pedestal.

11. The wine decanter pedestal system of claim 10, wherein the footprint area of the decanter is greater than twice the footprint area of the wine decanter pedestal.

12. The wine decanter pedestal system of claim 9, further comprising at least one of a chilling element and a heating element incorporated into the base.

13. The wine decanter pedestal system of claim 10, wherein the top surface comprises a raised feature configured to mate with a cavity within the bottom surface of the decanter.

14. The wine decanter pedestal system of claim 9, wherein the top surface of the base comprises a rounded cone shape.

15. The wine decanter pedestal system of claim 10, wherein a majority of the base is configured to fit within a cavity in a lower surface of the decanter.

16. A wine decanter pedestal system, comprising:

a wine decanter pedestal having a housing comprising a base configured to be supported by at least one foot above a surface upon which the wine decanter pedestal is placed, the base having a base center axis; and a rotary motor positioned below the base and having a rotary drive configured to output a torque, the rotary drive operably coupled to the base at an attachment point off-center from the base center axis such that rotation of the rotary motor causes the base to turn in circular spin motion and the base center axis to orbit about the rotary drive in a circular orbital motion.

17. The wine decanter pedestal system of claim 16, further comprising a weight sensor operably coupled to the base and configured to measure a weight of a decanter when placed upon the base.

18. The wine decanter pedestal system of claim 17, further comprising a controller within the housing, the controller configured to automatically adjust the torque of the rotary drive in response to the weight measured by the weight sensor to increase torque for heavier weights measured and decrease torque for lighter weights measured.

19. The wine decanter pedestal system of claim 16, further comprising a ledge surrounding a top surface and extending outward from the top surface, the ledge configured to support a bottom surface of a decanter placed on the top surface.

20. The wine decanter pedestal system of claim 16, further comprising a switch operably coupled to the base and configured to stop rotational movement of the motor in response to a decanter being removed from the base and start rotational movement of the motor in response to a decanter being placed on the base.

* * * * *